United States Patent [19]

Poppe

[11] Patent Number: 4,563,972

[45] Date of Patent: Jan. 14, 1986

[54] ANCHORING ARRANGEMENT FOR FLOATING STRUCTURES

[75] Inventor: Horst Poppe, Hamburg, Fed. Rep. of Germany

[73] Assignee: Blohm & Voss AG, Hamburg, Fed. Rep. of Germany

[21] Appl. No.: 564,646

[22] Filed: Dec. 22, 1983

[30] Foreign Application Priority Data

Dec. 22, 1982 [DE] Fed. Rep. of Germany ..... 3247463

[51] Int. Cl.[4] ..... B63B 21/24

[52] U.S. Cl. ..... 114/293

[58] Field of Search ..... 114/293–311, 114/219, 230; 52/723; 43/43.1

[56] References Cited

U.S. PATENT DOCUMENTS

| | | | |
|---|---|---|---|
| 2,587,724 | 3/1952 | Henderson | 52/723 |
| 3,455,269 | 7/1969 | Dean | 114/219 |
| 3,995,577 | 12/1976 | Gentry | 114/297 |
| 4,090,463 | 5/1978 | Soderberg | 114/294 |
| 4,196,558 | 4/1980 | Jungbluth | 52/723 |
| 4,383,493 | 5/1983 | Takamatsu et al. | 114/294 |

FOREIGN PATENT DOCUMENTS

| | | | |
|---|---|---|---|
| 456319 | 11/1936 | United Kingdom | 43/43.1 |

*Primary Examiner*—Trygve M. Blix
*Assistant Examiner*—Stephen P. Avila
*Attorney, Agent, or Firm*—Nils H. Ljungman

[57] ABSTRACT

The invention provides an improved anchor cable and weight system in which at least two separate weights are interconnected with a length of cable for the purpose of securing a floating structure to an anchoring ground. Each weight has a predetermined cross-sectional dimension and a spindle axially disposed therein for securing an anchor cable thereto. The anchor cable interconnecting two adjacent weights has a length selected to be no greater than the predetermined cross-sectional dimension of the weight. Additionally, two alternative embodiments of the anchor weight are also described herein.

18 Claims, 4 Drawing Figures

ANCHORING ARRANGEMENT FOR FLOATING STRUCTURES

FIELD OF THE INVENTION

The present invention relates to a technique for anchoring floating structures. More particularly, this invention is directed to an anchoring cable provided with several weights, typically employed for long-term anchoring.

BACKGROUND OF THE INVENTION

It is known to provide an anchoring arrangement for a floating structure which comprises an anchor cable extending from the structure and one or more weights attached to the cable. Each of the weights functions as an anchor. A drawback to the aforedescribed technique resides in the fact that in the case of the long-term anchoring of a floating structure such as a platform, the anchoring cable often becomes damaged through rubbing contact with the anchoring ground or bottom of the body of water. Such contact can cause the anchor cable to weaken and eventually part.

It is, therefore, an object of this invention to provide a technique for the anchoring of floating structures, which technique substantially eliminates undesired contact between the anchor cable and the anchoring ground or bottom.

It is another object of this invention to provide an anchoring weight comprising concrete which is cast into shape in, or jacketed with steel sheet.

SUMMARY OF THE INVENTION

The invention provides an improved anchor cable and weight system in which at least two separate weights are interconnected with a length of cable for the purpose of securing a floating structure to an anchoring ground or sea bottom. Each weight has a predetermined cross-sectional dimension and means axially disposed therein for securing an anchor cable thereto. The anchor cable interconnecting two adjacent weights has a length selected to be no greater than the predetermined cross-sectional dimension of the weight. Additionally, two alternative embodiments of the anchor weight are also described herein.

BRIEF DESCRIPTION OF THE DRAWINGS

The above, as well as other features and advantages of the present invention, will become apparent through consideration of the detailed description in connection with the accompanying drawings in which.

DETAILED DESCRIPTION OF THE INVENTION

Figure 1:
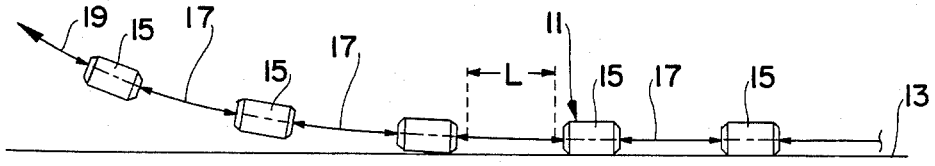
FIG. 1 is a somewhat schematical representation of an anchoring cable with weights used as sinkers, all in accordance with the teachings of this invention.

The general configuration of the invention and the environment in which it is utilized can be seen in FIG.

1. An anchoring apparatus, generally indicated by the reference character 11, is shown resting on an anchoring ground or bottom 13 in a body of water. The anchoring apparatus 11 includes one or more weights or sinkers 15 interconnected with lengths of anchor cable 17 and attached at one end thereof by a length of anchor cable 19 extending from one of the weights 15 to a floating structure which is not illustrated herein. The anchor cable (17 and 19) typically takes the form of a wire cable or rope, or a chain. As can be appreciated in FIG. 1, the anchor cable 17 is so disposed in relation to the several weights 15 that damage to the anchor cable 17 through rubbing contact with the bottom or anchor ground 13 is substantially eliminated. The weights 15 are configured so as to surround the anchoring cable 17 in a symmetrical manner. This configuration is achieved by providing an anchor cable 17 of predetermined length and by providing the weight with a predetermined cross-sectional dimension selected to prevent the aforedescribed damaging contact between the anchoring cable 17 and the anchoring ground 13.

Figure 2:
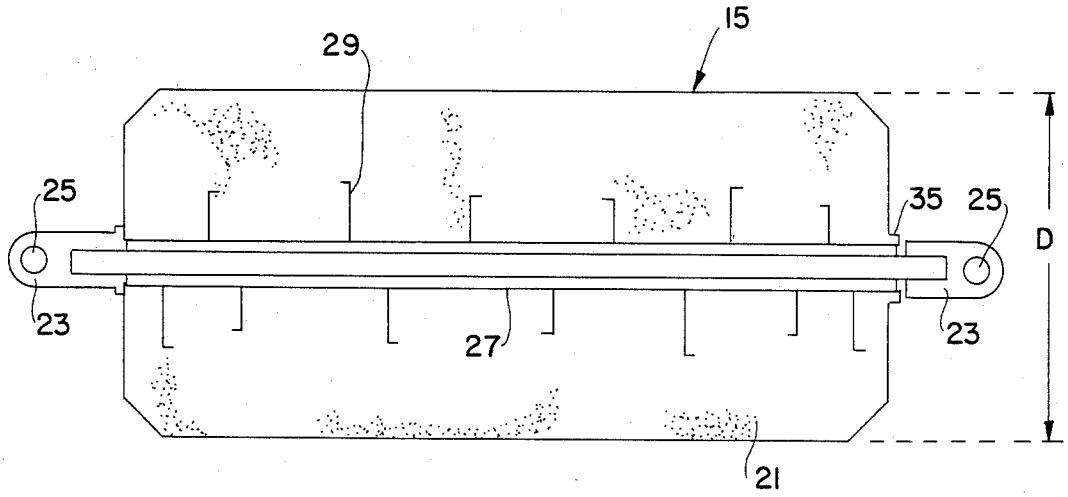
FIG. 2 is a section through an individual sinker made of cast concrete and weighing about 37 tons according to the present invention.

Turning now to FIG. 2, one embodiment of a weight 15 of the anchoring apparatus 11 of this invention is presented in section view. The weight 15 is of a material having sufficient mass to function as an anchor, preferably the material is a generally cylindrical concrete mass 21 with a predetermined cross-sectional dimension, such a diameter 'D' selected to support and maintain the anchor cable 17 above and away from the anchor ground 13. The weight 15 also includes a spindle 23 axially disposed therein and extending from each end thereof, having an eyelet 25 at at least one end, and preferably at both ends thereof. The eyelet 25 is an attachment point for securing the anchor cable 17, 19 thereto. The spindle 23 may comprise, for example, a flat iron or round bar. The spindle 23 is rotatably mounted within an axial tube 27 fixedly imbedded within the concrete mass 21. The axial tube 27 includes a plurality of retainer means 29 which extend therefrom and function as both a means for securing the axial tube 27 within the concrete mass 21 and as a reinforcement means for strengthening the concrete mass 21 and maintaining the structural integrity thereof. A locking member 35 is provided at each end of the spindle 23 to prevent the longitudinal axial displacement of the spindle 23 relation to the tube 27. The locking member 35 is described in detail in connection with FIG. 4.

Figure 3:
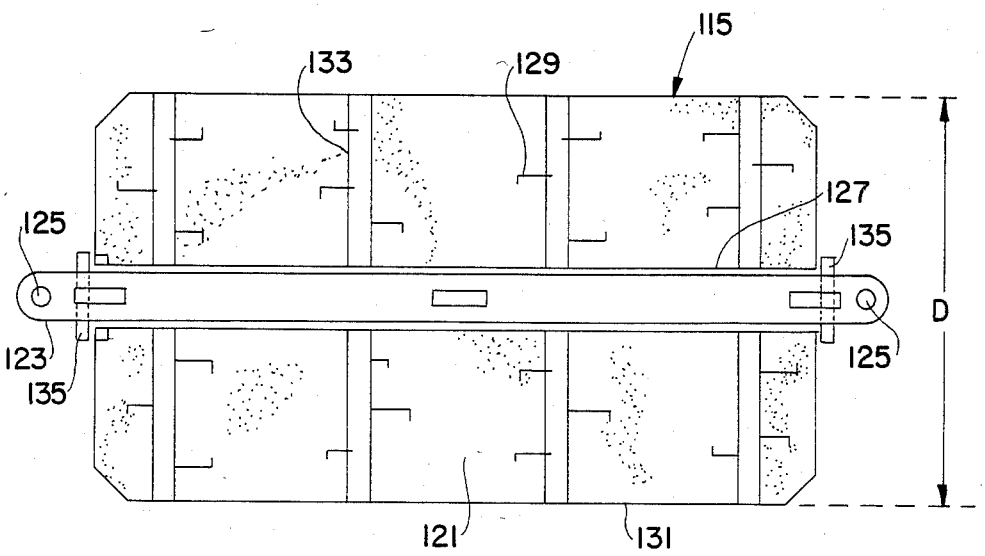
FIG. 3 is a section through an individual sinker weighing about 50 tons and comprising concrete clad in sheet steel, all according to this invention.
Figure 4:
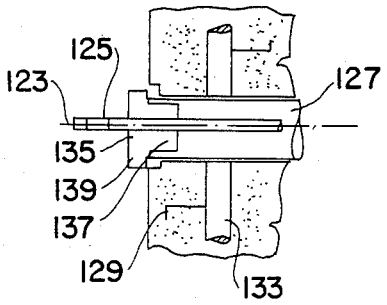
FIG. 4 is a partial detail of an individual sinker illustrating a flat iron spindle and spindle locking means all according to this invention.

An alternative embodiment of an anchor weight is shown in sectional view in FIG. 3 and is generally indicated by the reference character 115. The weight 115 is of a material having sufficient mass to function as an anchor, preferably the material is a generally cylindrical concrete mass 121. The weight 115 has a predetermined cross-sectional dimension, such as, diameter 'D' selected to support and maintain the anchor cable 17 which is of a predetermined length above the bottom or anchor ground 13. The weight 115 has a jacket 131 preferably of steel sheet, which is connected to an axial tube 127 by means of a plurality of radially disposed struts 133 extending therebetween. The struts 133 may include a plurality of retainer means 129 which extend therefrom and function as both a means for securing the combined metal structure to the concrete mass 121 and as concrete reinforcement means. The metal structure, including the jacket 131, axial tube 127 and struts 133, defines a mold into which concrete can be poured to cast the final anchor weight. A spindle 123 is axially disposed for rotatable movement within the axial tube 127 and extends from each end thereof. An eyelet 125 is provided at at least one end, and preferably at both ends of the spindle 123 in order to serve as an attachment point for the anchor cable 17, 19. The spindle 123 may comprise, for example, a flat iron or round bar and may be provided with a locking member 135 to minimize longitudinal axial displacement of the spindle 123 relative to the axial tube 127 as shown in FIG. 4. A locking member 135 is fixedly secured to each end of the spindle 123 after insertion of the spindle 123 into the axial tube 127 at a location which facilitates rotational movement of the spindle 123 within the axial tube 127. The locking member 135 also acts as a rotational support means when used in combination with a flat iron spindle 123 which combination is shown in FIG. 4. Here the locking member 135 has a portion with a first diameter 137 which rests within the axial tube 127 and a portion with a second diameter 139 of greater cross-sectional dimension which prevents axial displacement.

In utilizing either the weight 15 or 115 described in connection with FIG. 2 or FIG. 3, it is to be appreciated that the cross-sectional dimension of the weight 15(115 of FIG. 3) and the length of anchor cable 17 extending between adjacent weights 15(115 of FIG. 3) has a unique relationship. While the weights 15(115 of FIG. 3) have been described as generally cylindrical, other similar configurations can be employed without departing from the scope of the appended claims. In a cylindrical weight 15(115 of FIG. 3) and anchor cable 17 system as shown in FIG. 1, the length "L" of the anchor cable 17 extending between the pair of adjacent weights 15(115 of FIG. 3) is chosen to be of such a dimension that the anchor cable 17 does not readily come into abrasive contact with the bottom 13 during long term anchoring of a floating structure, such as a platform or even a floating drilling rig. Depending upon the characteristics of the anchor cable 17, such as whether the anchor cable 17 is a chain or wire rope and whether the movements of the floating structure due to depth, movement of the seas from the action of tides, storms, etc., and the nature of the bottom or anchor ground 13, the length of the anchor cable 17 between weights 15 may vary. In some embodiments, the length "L" of the anchor cable 17 may be greater than the diameter 'D'. In other embodiments according to the invention, the length "L" is no longer than, and even, in alternative embodiments, preferably slightly shorter or substantially shorter than the measurement reflecting the cross-sectional dimension of the weight or the diameter of a cylindrical weight as illustrated in FIG. 1. Thus, even in the event that the weights 15 are laid close to one another as the anchor is deployed, the cable 17, interconnecting adjacent weights 15, is suspended above the anchor ground 13 and rubbing damage therebetween substantially eliminated.

In yet another embodiment, if wire rope is used for the anchor cable 17, the predetermined length "L" may also be dependent upon the characteristics of the wire rope, its means connection to the spindle 23. Wire rope, depending upon its inherent characteristics and connection due to its size, thickness, number of wire strands, number of groups of strands making up each portion thereof, etc., may have a tendency to coil or even protrude horizontally if there is any slack in the cable 17. This coiling and/or horizontal protrusion may have a tendency to elevate the cable 17 between the weights 15 over the anchor ground 13 even though the length "L" is substantially greater than the diameter 'D' of the weights 15. The length of "L" between the weights 15 of the cable 17 can be predetermined by experimentation with the cable 17 to be used in a specific application by cutting different lengths of a specific type of wire rope, having determinable stiffness or rigidity, or chain and connecting these lengths between weights 15 and subsequently proceeding to observe the action of the cable 17 in a real or simulated undersea environment of interest and then measurements can be made to determine the wear on the cable 17 whereupon a determination is made whether damaging contact with the anchor ground 13 is substantially eliminated. Even the manner and tightness of the attachment of the cable 17 to the spindle 23 and the eyelet 25 or other anchoring means may affect the predetermined length "L" by varying the effective axial stiffness or rigidity of the, e.g., wire rope which stiffness if increased may tend to elevate the cable 17 somewhat from the anchor ground or bottom 13 and thus effectively permit the use of a longer length "L" than if a less stiff cable type or cable attachment were used.

Further, if the bottom or anchor ground 13 consisted generally of a soft, silty sand which would allow the weights 15 to sink substantially thereinto, the predetermined length "L" may require a substantially shorter dimension in order to substantially reduce the action of this abrasive sand from damaging the cable 17 by contact therewith. Also, the abrasiveness of the, e.g., sand, from the anchor ground 13 may under specific conditions also have an effect in determining the length "L" required to substantially eliminate damage.

When using a minimally stiff cable structure including the cable 17 and the fastening arrangement such as the eyelets 25, the length "L" of the cable 17 usually will not exceed the diameter "D" except possibly in a very soft but firm non-abrasive bottom 13. However, if the cable arrangement is stiffer than minimal, the length "L" will be increasable from the minimum length to a greater length. Contributing factors to effective stiffness will be the stiffness of the cable 17 and the fastening arrangement which may include a rigid, non-relatively movable fastening scheme such as bolting, etc. If the end of a wire rope having considerable rigidity is fastened substantially non-movably to the spindle 23, the wire rope with slack will protrude horizontally a substantial distance before drooping substantially to make damaging contact with the anchor ground 13. A series of lengths "L" can be fastened between the weights 15 to determine the greatest length before damaging contact occurs. When a predeterminable effective rigidity is reached, the length "L" will be greater than 'D'. For a specific known bottom, length "L" is determinable when the degree of sinking of the weights 15 into the anchor ground or bottom 13 is determine or known. When the cable 17 of length "L" does not touch the bottom 13, contact damage is eliminated completely. However, under certain conditions regarding sea currents, movement of floating structure, some touching may be acceptable in that damaging contact with the anchor ground or bottom 13 is minimal.

What has been described is a unique anchor cable and weight system in which cable length and weight cross-sectional dimension have a predetermined relationship. Additionally, two embodiments of a weight for use with this anchoring system have been described.

The invention, as described hereinabove in the context of a preferred embodiment, is not to be taken as limited to all of the provided details thereof, since, modifications and variations thereof may be made without departing from the spirit and scope of the invention.

What is claimed is:

1. In an anchor cable and weight system in which at least two separate weights are interconnected by anchor cable for the purpose of securing a floating structure to an anchoring ground the improvement wherein each said weight comprises a concrete mass having an axially disposed tube therein, said tube having a plurality of retainer means therein securing said tube within said concrete mass and a spindle rotatably mounted within said tube, said spindle having eyelets at each end thereof for securing the anchor cable thereto, and wherein each said weight has a predetermined cross-sectional dimension and the anchor cable interconnecting two adjacent weights of said at least two weights, said interconnecting anchor cable having a length selected to have a pre-determined relationship with said predetermined cross-sectional dimension to avoid substantial contact, in use, between the cable and the anchor ground therebelow whereby damaging contact between said interconnecting anchor cable and the anchor ground is substantially eliminated.

2. The improved anchor cable and weight system according to claim 1 wherein said predetermined cross-sectional dimension is a diameter of each said weight.

3. The improved anchor cable and weight system according to claim 1 wherein said predetermined relationship of said length of said anchor cable interconnecting two adjacent weights to said predetermined cross-sectional dimension substantially corresponds to unity.

4. The improved anchor cable and weight system according to claim 3 wherein said predetermined cross-sectional dimension is a diameter of each said weight.

5. The improved anchor cable and weight system according to claim 1 wherein said predetermined relationship of said length of said anchor cable interconnecting two adjacent weights to said predetermined cross-sectional dimension substantially corresponds to less than unity.

6. The improved anchor cable and weight system according to claim 2 wherein said predetermined relationship of said length of said anchor cable interconnecting two adjacent weights to said predetermined cross-sectional dimension substantially corresponds to less than unity.

7. The improved anchor cable and weight system according to claim 1 wherein the spindle comprises a round bar and locking means are disposed at each end of said spindle in order to prevent longitudinal axial displacement of said spindle within said axially disposed tube.

8. The improved anchor cable and weight system according to claim 1 wherein the spindle comprises a flat iron member and also wherein locking means are disposed at each end of said spindle in order to prevent longitudinal axial displacement of said spindle within said axially disposed tube, said locking means having a portion with a first diameter which rests within said tube to facilitate the rotational movement of said spindle within said tube and a further portion with a second diameter of greater cross-sectional dimension than said first diameter which further portions preventing said axial displacement.

9. The improved anchor cable and weight system according to claim 8 wherein each weight comprises a generally cylindrical metal jacket having an axially disposed tube supported therein by a plurality of struts extending between said tube and said jacket, each of said struts including retainer means extending therefrom and an integral concrete mass within said jacket and wherein a spindle having eyelets at each end thereof for securing an anchor cable thereto, is rotatably mounted in said axially disposed tube.

10. The improved anchor cable and weight system according to claim 9 wherein the spindle comprises a round bar and also wherein locking means are disposed at each end of said spindle in order to prevent longitudinal axial displacement of said spindle within said axially disposed tube.

11. The improved anchor cable and weight system according to claim 10 wherein the spindle comprises a flat iron member and also wherein locking means are disposed at each end of said spindle in order to prevent longitudinal axial displacement of said spindle within said axially disposed tube, said locking means having a portion with a first diameter which rests within said tube to facilitate the rotational movement of said spindle within said tube and a further portion with a second diameter of greater cross-sectional dimension than said first diameter which further portions preventing said axial displacement.

12. The improved anchor cable and weight system according to claim 1 wherein the anchor cable is wire rope.

13. The improved anchor cable and weight system according to claim 11 wherein the anchor cable is wire rope.

14. The improved anchor cable and weight system according to claim 1 wherein the anchor cable is chain.

15. The improved anchor cable and weight system according to claim 11 wherein the anchor cable is chain.

16. The improved anchor cable and weight system according to claim 15 wherein said predetermined relationship of said length of said anchor cable interconnecting two adjacent weights to said predetermined cross-sectional dimension substantially corresponds to unity.

17. The improved anchor cable and weight system according to claim 15 wherein said predetermined relationship of said length of said anchor cable interconnecting two adjacent weights to said predetermined cross-sectional dimension substantially corresponds to less than unity.

18. In an anchor cable and weight system in which at least two separate weights are interconnected by anchor cable means for the purpose of securing a floating structure to an anchoring ground, the improvement wherein each said weight comprises a concrete mass having an axially disposed tube therein, said tube having a plurality of retainer means therein securing said tube within said concrete mass and a spindle rotatably mounted within said tube, said spindle having eyelets at each end thereof for securing said anchor cable thereto, and wherein each said weight has a predetermined cross-sectional dimension, and said anchor cable means interconnecting two adjacent weights of said at least two weights, said interconnecting anchor cable means having an effective rigidity and having a length selected to have a predetermined relationship with said predetermined cross-sectional dimension, said selected cable length being a function of said cable rigidity, such that, for minimum rigidity, said selected cable length is selected to be no greater than said predetermined cross-sectional dimension in order to avoid damaging contact, in use, between said interconnecting anchor cable means and said anchoring ground; and as said effective rigidity increases, said selected cable length is selected to be at least equal to or greater than said predetermined cross-sectional dimension, but less than a length at which said damaging contact, in use, between said interconnecting anchor cable means and said anchoring ground, occurs.

* * * * *